United States Patent [19]

Maboux et al.

[11] Patent Number: 4,624,065

[45] Date of Patent: Nov. 25, 1986

[54] ALPINE SKI BOOT

[75] Inventors: Michel Maboux, Seynod; Jean Paris, St-Jorioz, both of France

[73] Assignee: Salomon, S.A., Annecy, France

[21] Appl. No.: 389,763

[22] Filed: Jun. 18, 1982

[30] Foreign Application Priority Data

Jun. 24, 1981 [FR] France ..... 81 12907

[51] Int. Cl.[4] ..... A43B 5/04

[52] U.S. Cl. ..... 36/120

[58] Field of Search ..... 36/117–121, 36/115, 105; D2/276

[56] References Cited

U.S. PATENT DOCUMENTS

| | | | |
|---|---|---|---|
| D. 271,441 | 11/1983 | Salomon et al. | D2/276 |
| 3,609,887 | 10/1971 | Hickmann et al. | 36/121 |
| 3,747,235 | 7/1973 | Post . | |
| 4,008,532 | 2/1977 | Kilbourn et al. | 36/120 |
| 4,095,356 | 6/1978 | Robran et al. | 36/121 |
| 4,186,501 | 2/1980 | Salomon | 36/121 |

FOREIGN PATENT DOCUMENTS

| | | | |
|---|---|---|---|
| 2316443 | 3/1974 | Fed. Rep. of Germany . | |
| 2731120 | 1/1976 | Fed. Rep. of Germany | 36/121 |
| 2807348 | 8/1979 | Fed. Rep. of Germany . | |
| 2946010 | 5/1980 | Fed. Rep. of Germany . | |
| 3115529 | 1/1982 | Fed. Rep. of Germany . | |
| 2103171 | 4/1972 | France . | |
| 2341283 | 9/1977 | France . | |
| 2371162 | 6/1978 | France . | |
| 2425207 | 12/1979 | France . | |
| 2433311 | 3/1980 | France | 36/121 |

*Primary Examiner*—James Kee Chi

*Attorney, Agent, or Firm*—Sandler & Greenblum

[57] ABSTRACT

A ski boot for use in Alpine skiing formed of a shell base and an upper, the upper being pivotable around a transverse horizontal journal axis. The upper is formed of a cuff and a rear spoiler. An extension is provided to extend from the journal axis and is adapted to cooperate at its end spaced from the upper with a support point on the shell base. The extension comprises a flexion blade extending between the journal axis and the support point which resists the forward pivoting movement of the upper relative to the shell base.

40 Claims, 15 Drawing Figures

FIG. 2,

FIG. 12.
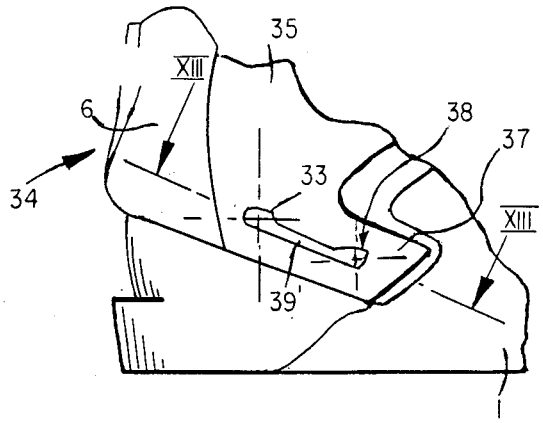
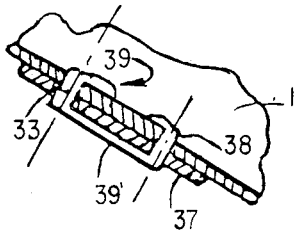
FIG. 13.

ALPINE SKI BOOT

BACKGROUND OF THE INVENTION

1. Field of the Invention

The invention relates to a boot for use in Alpine skiing of a type which is generally well known and which comprises a rigid shell base having a sole and on which an upper composed of a cuff and a rear spoiler is journalled to pivot around a transverse horizontal axis.

2. Description of Prior Art

The general orientation of the upper is measured for purposes of simplicity with reference to "the axis of the upper"; the upper axis normally being inclined frontwardly with respect to the vertical. The upper is made integral with the shell base and is inclined at an angle designated the "advancement angle". At rest the advancement angle of the upper is designated as the "static" advancement angle. The upper pivots around the static or median position since the upper is journal mounted on the shell base. In general, the more advanced the skier, and thus the more the upper is flexed with respect to the shell base, the greater is the static (median) advancement angle which is desired. The advancement angle can be on the order of about 13°-20° and sometimes may even reach 25° while for the average skier an angle of 8°-15° is generally considered to be optimum.

Furthermore, depending upon the particular type of skiing being performed and the state of the snow, the skier may demand greater or lesser flexibility in the journal of the upper on the shell base. Therefore, it would be useful to be able to vary the advancement angle of the upper depending on the conditions. Thus, a relatively high rigidity in the upper is preferred in competition skiing on hard snow or ice, while greater flexibility is required on powdered snow in order to better distribute the weight applied to the ski and to spare the muscles during descent as well as when attempting to reach the flat ski position.

The above considerations have resulted in more and more skiers requiring not only that their boots have an average or static advancement angle which corresponds, or can be made to correspond, to their personal needs, but also that their boots exhibit a rigidity in the journal of the upper on the shell base which increases as a function of the bias which they exert on the upper, which adds to the comfort and safety of the user.

SUMMARY OF THE INVENTION

The above objectives are achieved by means of the ski boot of the invention, which finds particular use in Alpine skiing. The boot comprises a shell base and an upper, the upper being pivotable around a transverse horizontal journal axis. The upper is formed of a cuff and a rear spoiler. The term rear spoiler as used herein is considered to include rear spoilers which are separate from but secured onto the shell base, as well as spoilers which are integral with the shell base. An extension extends from the upper and is adapted to cooperate with a support point on the shell base. The extension includes a flexion blade extending between the journal axis and the support point and serves to resist forward pivoting of the upper relative to the shell base. The boot may be of the front or rear insertion type and more than one extension may be used, e.g., extensions may be provided on both sides of the boot.

In one embodiment, the extension is a flexion blade which extends longitudinally from the cuff at the level of the journal axis along the general direction of the longitudinal axis of the boot. The extension may be made to extend forwardly or rearwardly relative to the orientation of the boot.

According to another embodiment, the extension includes a flexion blade extending downwardly from the cuff, which blade is aligned generally with the axis of the upper. In this embodiment, the support point is positioned in the general vicinity of the heel of the boot.

The extension may include a flexion blade which has been prestressed during assembly.

According to one preferred embodiment, the journal axis and the support point may be established by means of a single staple. The staple can be interchangeable and can serve as a supplemental spring which serves to augment the flexion of the blade.

According to yet another embodiment the boot may comprise means for adjusting and pre-setting the static advancement angle of the upper relative to the shell base. The means for adjusting the static advancement angle may comprise means for locking the end of the extension at the support point at a predetermined position along an arctuate slot in the shell base. An slot is provided in the extension which is identical to that of the shell base, and these slots guide adjustment members such as screws which are tightened at the desired settings. The means for adjusting the static advancement angle of the upper, may include means comprising a cylindrical shank extending through the slot in the the shell base, the shank ending in a head adapted to press against the internal surface of the shell base. The shank is secured to the extension by means of a threaded shank upon which is screwed a nut adapted to press the extension against the shell base whereby the position of the extension relative to the shell base can be varied by loosening and retightening the nut. The interior surfuace of the base has a groove extending along the slot which is adapted to seat the head. The head has spurs adapted to cooperate with cavities provided in the groove of the shell base at regular intervals along the slot so as to define predetermined positions along the slots.

Besides providing means for adjusting the static advancement angle, it is also possible to provide means for adjusting the effective length of the extension, and more particularly of the flexion blade, between the journal axis and the support point. The means for adjusting the effective length of the extension can assume the form of a cursor whose position along the extension can be varied to establish the desired support point of the extension on the shell base.

The boot may further include an arrangement whereby both the static advancement angle as well as the effective length of the flexion blade can be adjusted. The boot can be provided with means for separately adjusting each of the features, or with single means whose adjustment results in the setting of both the static advancement angle and length of the flexion blade according to a predetermined relationship. The means for adjustment may additionally serve to secure the upper to the shell base.

BRIEF DESCRIPTION OF THE DRAWINGS

The invention will now be described in detail with reference to the annexed drawings given by way of nonlimiting example only in which:

FIGS. 12 and 13 illustrate an arrangement according to the invention in which the support point of the flexion blade is provided by means of a clip or staple;

DESCRIPTION OF PREFERRED EMBODIMENTS

The invention relates to a boot whose cuff has at its lower portion covering the shell base, at least on one side, and approximately radially to the journal axis, an extension cooperating adjacent to its end with a support point integral with the shell base. A spring or flexion blade is defined between the journal axis and the support point on the shell base which resists bending (changing of the advancement angle of the upper).

In certain embodiments, the support point integral with the shell is achieved by the attachment on the shell base of the extension which serves as and includes the flexion blade. The effective length of the blade is adjustable which makes it possible to vary the rigidity of the boot, as well as making it possible to vary the initial position of the cuff with respect to the shell base (the static advancement angle).

Figure 1:
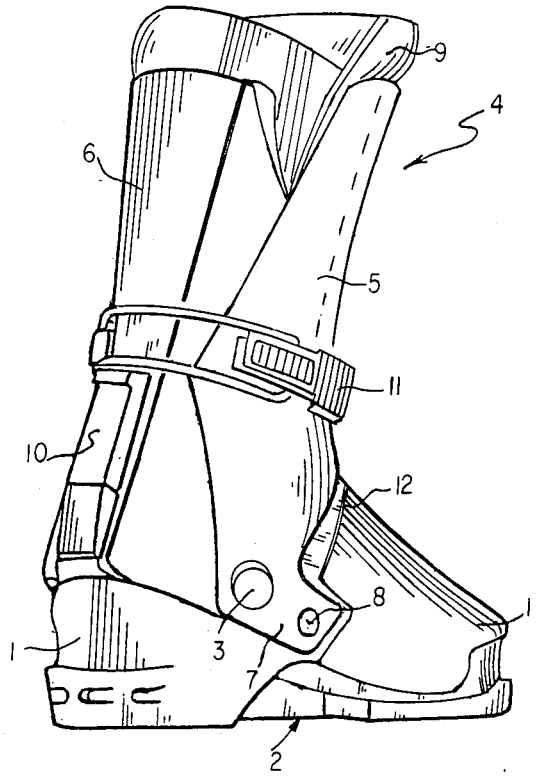
FIG. 1 illustrates a rear perspective view of a ski boot according to one embodiment of the invention in which the flexion blade is directed generally along the longitudinal axis of the boot.
Figure 2:
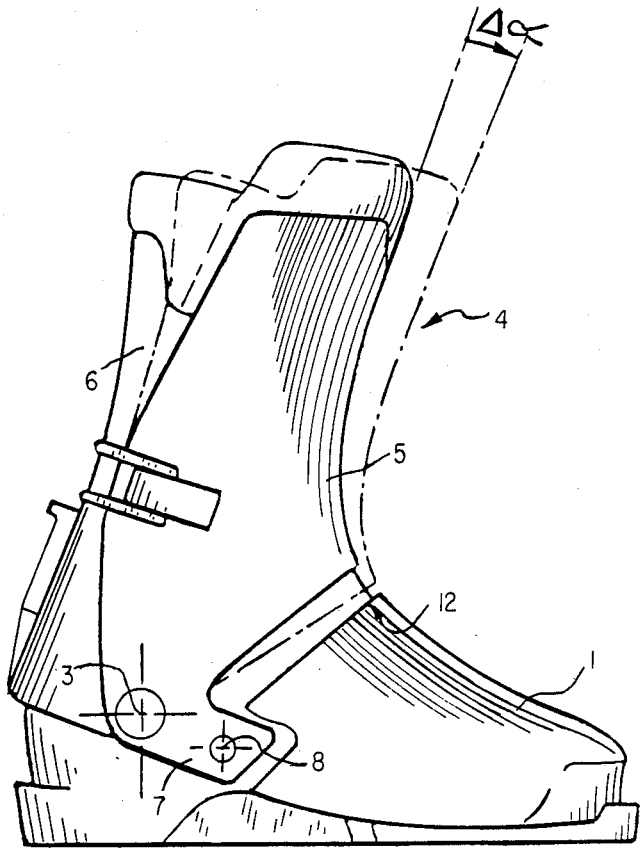
FIG. 2 is a lateral view of the boot shown in FIG. 1 illustrating the change of the advancement angle (the position shown in chain lines)

The boot shown in FIGS. 1 and 2, of the rear opening type, comprises in a known fashion a rigid shell base 1 comprising a sole 2. An upper 4 comprising a cuff 5 and a rear spoiler 6 partially covers shell base 1 by means of its lower portion on which it is journalled around a transverse horizontal journal axis 3. Upper 4 and shell base 1 encase an inner slipper 9. An internal foot tightening lever 10 and at least one closure appratus of the lower leg 11 which is conventionally constituted by a lever and buckle are likewise shown.

Figure 11:
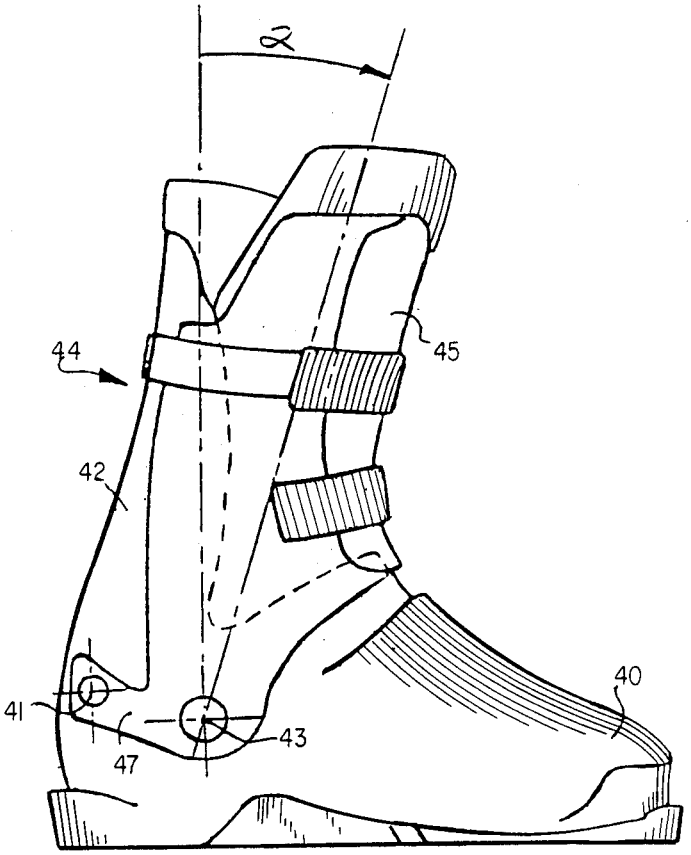
FIG. 11 illustrates another embodiment of the boot according to the invention in which the upper of the boot opens in front while the flexion blade extends radially from the journal axis of the upper and is directed towards the rear of the boot, the rear of the upper (spoiler) being integral with the shell base.

Although the invention can be equally applied in the case of a boot having a front opening (front insertion), it is of greatest value for use in boots having an opening in the rear (rear insertion) and it is for this reason that it is described in this context. In effect, the front opening would require particular constructional arrangements of the upper to put the technique of the invention into practice and would be achieved in a manner different from where a rear opening is used as is illustrated in FIG. 11.

Figure 3:
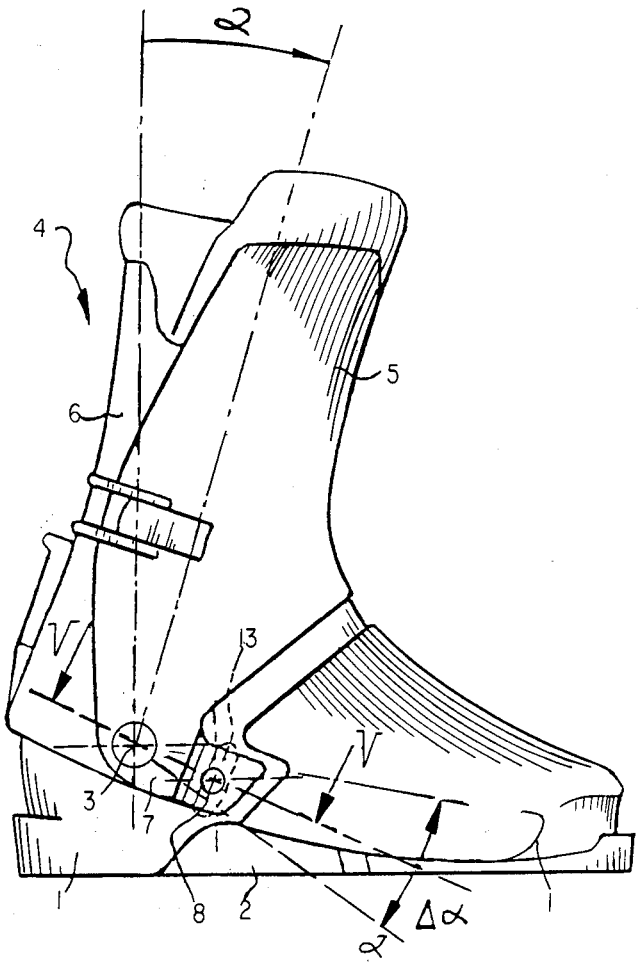
FIG. 3 illustrates an embodiment of the invention in which the static advancement angle is adjustable.

As may be seen front FIG. 3, the axis of upper 4 which corresponds to the orientation of the leg of the skier, is not normal to the horizontal plane associated with shell base 1 and defined by sole 2 but is rather inclined frontwardly at an angle $\alpha$ called the advancement angle. The extent of forward variation $\Delta\alpha$ (FIG. 2) of this advancement angle $\alpha$ is limited in a known manner by a stop 12 carried by shell base 1 constituting an edge for the anterior edge of cuff 5. This upper limit imposed on the forward advancement angle $\alpha$ is selected to resist too substantial flexions of the leg which could otherwise result in lesions of the Achilles tendon.

In the embodiment of the invention illustrated in FIGS. 1 and 2, the static advancement angle $\alpha$ is defined by the construction of the boot. This angle $\alpha$ as has previously been described, varies ($\Delta\alpha$, shown in chain lines in FIG. 2) during use as a function of the bias of the leg of the skier imposed on upper 4 which can turn around its journal axis 3 on shell base 1. Likewise, as was noted above, it is desirable that an increasingly antegonistic bias which increases at the same time that the advancement angle $\alpha$ increases, resist rotation of the upper around axis 3 by tending to bias upper 4 back to its rest position. This aim is achieved by positioning at least one spring between cuff 5 and shell base 1. According to the invention, this spring is constituted by an extension 7 of cuff 5 which can be secured thereon, which poses no problem in particular, or which can simply be made of one piece therewith. This generally longitudinal extension situated approximately at the level of journal axis 3 is made integral in the general vicinity to of its end 8 with shell base 1. This integralization can be achieved, for example, by screws or rivets as is seen from FIGS. 1 and 2 or further by any other appropriate means such as 22 illustrated in FIG. 6 and which will be discussed further below.

Between journal 3 and attachment 8 of extension 7, the extension responds to forces which tend to vary the advancement angle $\alpha$ as a flexion blade or return spring. The rigidity of this spring obviously depends on the geometry of extension 7, and particularly upon the distance separating inserts 3 and 8, and on the shape of the spring which can have openings and a plurality of active arms, which may be parallel or not (not shown). Furthermore, it is clear that a single spring 7 can be provided positioned on one side or the other of the boot or on the contrary that the boot can be equipped with such a spring on both of its sides. It should further be noted that spring 7 can be prestressed in one direction or the other during assembly by the positioning of the attachment 8 on shell base 1 and that it is likewise capable of providing support in both directions, i.e., in frontward and/or rearward support of the leg of the skier, even though it is essentially of greatest value during frontward flexion.

The construction which has just been described with reference to FIGS. 1 and 2, while being of great value in itself, definitely fixes the static advancement angle $\alpha$ and the intensity of the return force opposing changes in the frontward inclination of the upper. As was noted above, it is often desirable that at least one or the other of these two parameters be adjustable by the skier as a function of his personal abilities and the conditions of use.

Figure 4:
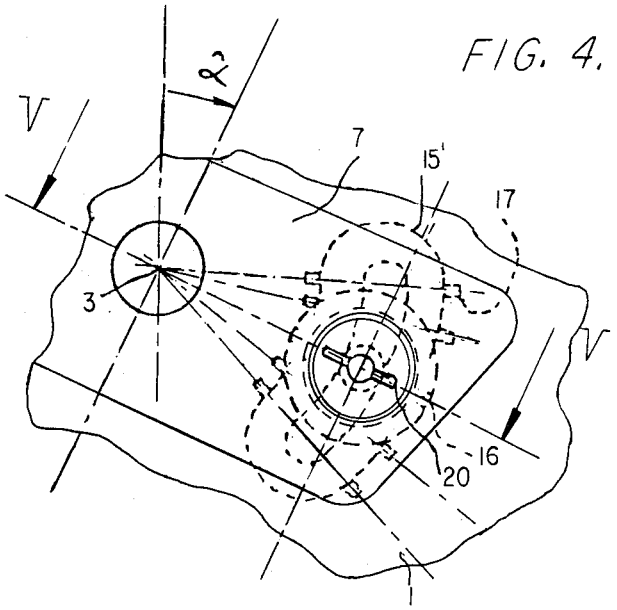
FIGS. 4 and 5 illustrate, in detail, one possible embodiment for the positioning of the support point of the blade on the cuff and of its attachment onto the shell base of the boot of FIG. 3.
Figure 5:
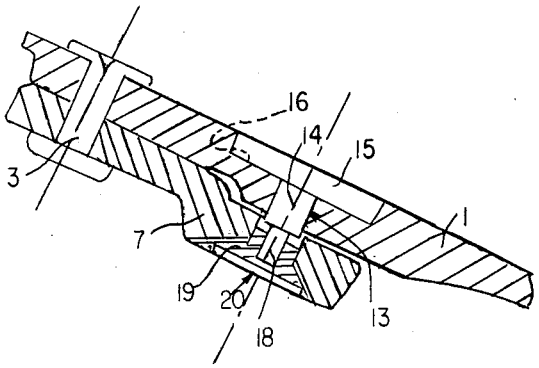

In the embodiment of the invention illustrated in FIGS. 3, 4 and 5, static advancement angle $\alpha$ can be easily adjusted to the value that the skier deems to be optimum. To do this, attachment point 8 of cuff 5 on shell base 1 can be fixed as desired between two limiting positions along the arc of a circle having its center on journal axis 3. To this end, means including a slit 13 is provided in shell base 1 having an arctuate shape corresponding to that of the slit in the upper. Slit 13 is traversed by a cylindrical smooth shank 14 ending on the interior of the boot in a head 15, which is, for example, countersunk and resting on one face against the end of a groove 15' having a shape corresponding to slit 13 and in which it is lodged. The support surface of head 15 preferably comprises two spurs 16 which are diametrically opposite one another and lodged in corresponding cavities 17 provided in shell base 1 at regular spaces along the walls of arctuate groove 15'. The cooperation of spurs 16 and cavities 17 makes it possible to select a precise position of the head without risk of shank 14 sliding along the length of slit 13. Shank 14 extends from the side opposite shell base 1 by means of a threaded portion 18 which extends through extension 7 of cuff 5 and receives a nut 19. Nut 19, preferably rounded and having on its upper surface a groove 20 for tightening, is lodged in a countersunk cavity in the extension 7 and presses the extension against shell base 1. Spurs 16 are held withn positioning cavities 17 as nut 19 is tightened and thus assure the attachment at 8 of the two elements.

It is clear from FIGS. 3 and 5 that loosening of nut 19 permits displacement of elements 14, 15, 16, 18 along the length of slit 13 by pivoting cuff 5 around journal 3 and that tightening of nut 19, when the selected position is reached, makes it possible to set the value of static advancement angle $\alpha$ along the latitude shown by the double arrows in FIG. 3.

Figure 14:
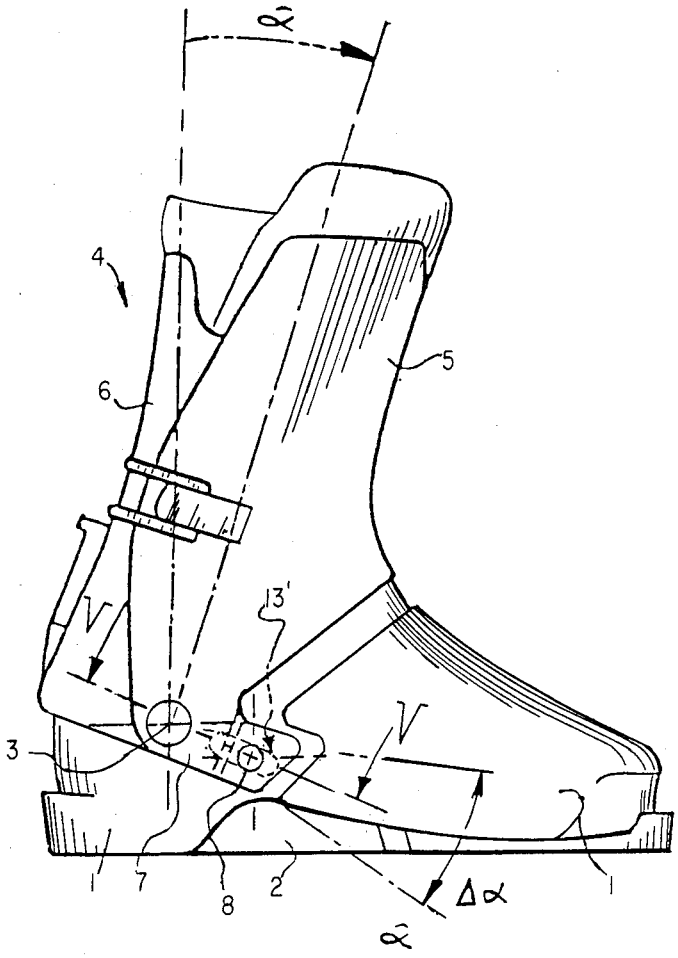
FIG. 14 illustrates an embodiment in which the effective length of the flexion blade is variable.

What has just been said for the adjustment of the value of the static advancement angle $\alpha$ may likewise be applied to the adjustment of the rigidity of the flexion spring or blade which is constituted by extension 7, by varying the effective length thereof. It suffices in effect to provide a slit 13' radially along the length of extension 7 with respect to journal axis 3 and a corresponding slit in shell base 1 (see FIG. 14). Displacement of attachment point 8 may again be achieved by elements such as 14, 15, 16, 18 and the setting of this point in place at the selected position defines the rigidity, at rest, of the apparatus.

Figure 15:
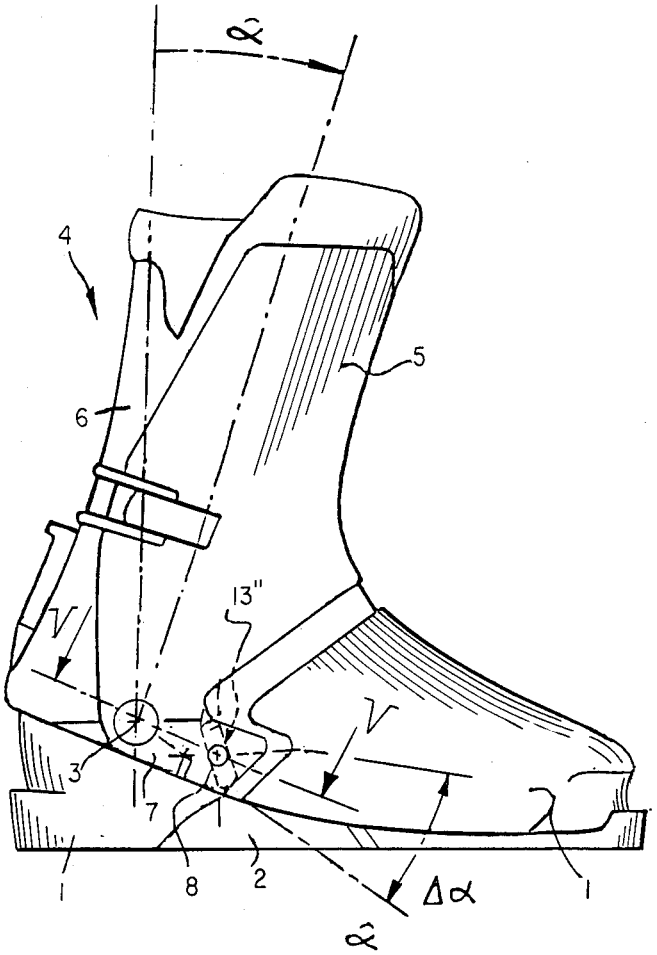
FIG. 15 illustrates an embodiment in which both the length and static advancement angle of the flexion blade are made simultaneously adjustable.

If desired, a combination of the two arrangements described above, i.e., two separate adjustment systems, is mechanically possible but would possibly be too cumbersome. On the other hand, a simultaneous adjustment of the static advancement angle apa and the rigidity of the flexion blade according to a predetermined function relating them to one another is possible without problem by utilizing the corresponding trajectory for slit 13 of extension 7 and shell base 1. FIG. 15 illustrates one such possible trajectory in which slit 13'' is at a diagonal relative to the positions shown in FIGS. 3 and 14.

Figure 6:
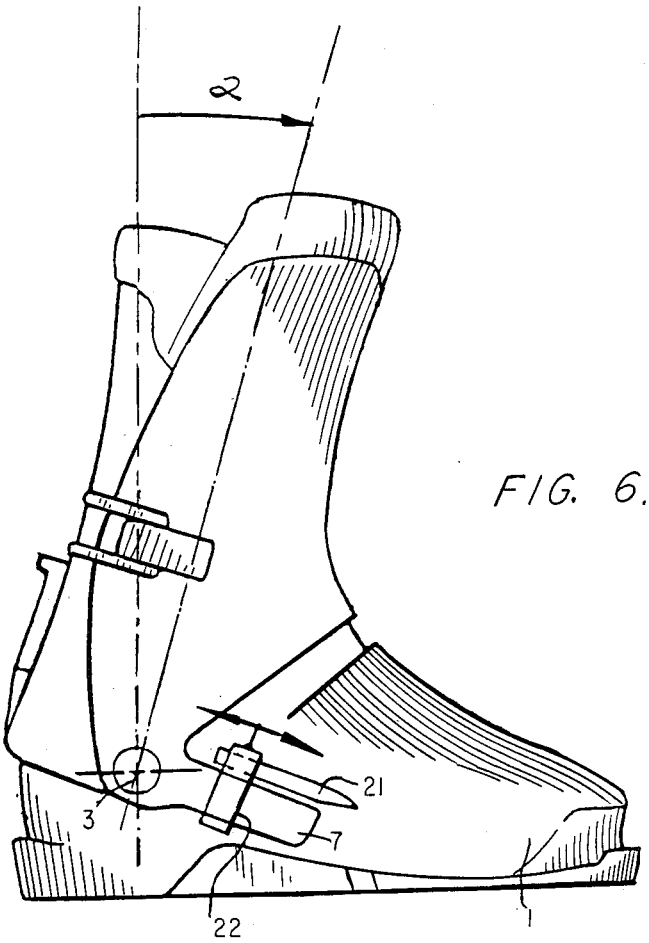
FIG. 6 illustrates another embodiment of the invention in which the rigidity of the upper is adjustable.

FIG. 6 illustrates another embodiment of the invention in which static advancement angle apa is fixed but in which the rigidity of flexion blade 7 is varied by varying the effective length of the blade. To achieve this, shell base 1 supports a longitudinal rail, track or groove 21 applied thereto or integral therewith which acts as a guide. A slide or cursor 22, for example, in the form of a bit, simultaneously rides and secures rail 21 and extension 7 and can be locked into position at the selected location along these two elements.

Figure 7:
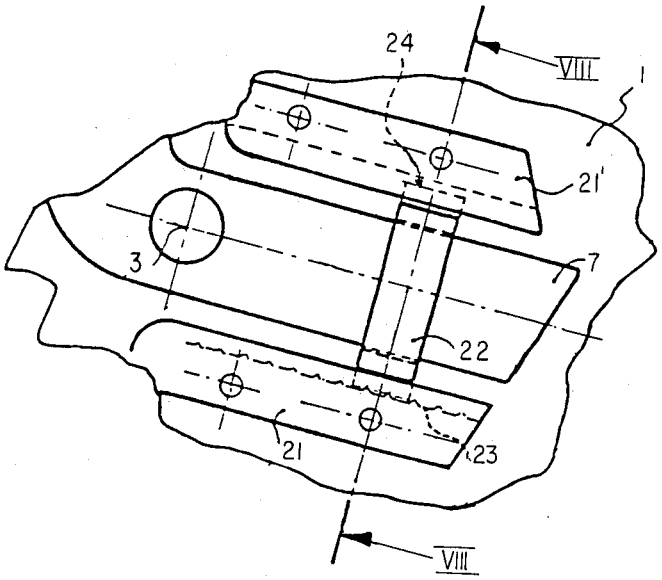
FIGS. 7 and 8 illustrate an alternative embodiment of the apparatus shown in FIG. 6.
Figure 8:
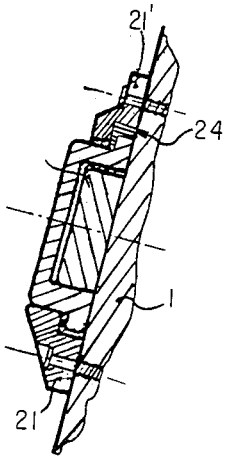

FIGS. 7 and 8 illustrate an arrangement which is a variation of the apparatus shown in FIG. 6. A cursor 22 is located between lower slide 21 and upper slide 21' which are attached, for example, by screws or rivets onto shell base 1. Lower and upper slides 21 and 21' guide cursor 22. Cursor 22 covers and cooperates with extension 7. Slide 22 has a lower notched edge 23 cooperating with a serrated edge or corresponding track of lower slide 21. A pressure spring 24 is biased against upper slide 21' whereby the upper edge of slide 22 biases slide 22 against lower slide 21 to place notches 23 into cooperation with the corresponding teeth thus stopping any displacement of slide 22 with respect to shell base 1. The effective length of extension 7 between journal axis 3 and slide 22 can thus be very easily adjusted, this length becoming effectively active as soon as a frontward bias of cuff 5 brings the lower edge of extension 7 into positive contact with the portion of slide 22 which is adjacent to it. As may be seen from FIG. 8, extension 7 can be made to fit tightly within the cursor such that any forward movement of the upper is resisted by extension 7.

Figure 9:
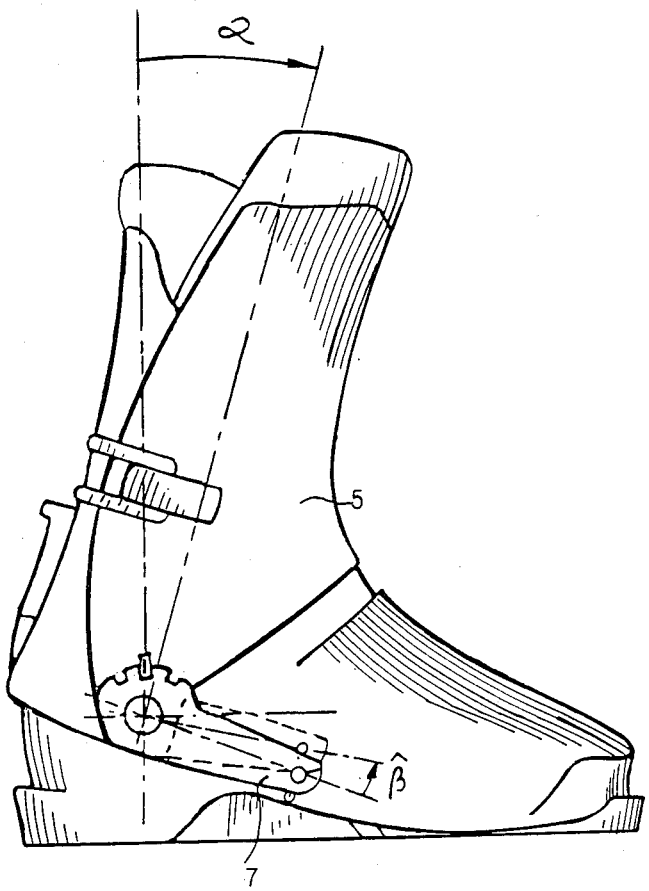
FIG. 9 illustrates an embodiment according to the invention which is useful where the section serving as the flexion blade is affixed onto the bottom of the cuff rather than being integral therewith.

FIG. 9 illustrates a system in which extension 7 is secured to the upper by means which allow for different initial settings $\beta$ of the extension relative to the upper. Such means may include a slotted surface on the extension with a pin or shank being used to select various initial settings of the angular position of the extension relative to the journal axis. The other end of the extension is provided with a pin or shank which is inserted within and cooperates with a slot in the shell base where it can be fixed as desired. In this embodiment, angle $\alpha$ is independent of $\beta$. This system effectively permits the skier to both select static advancement angle $\alpha$ while likewise permitting the skier to select an appropriate degree of flexional resistance in the extension.

Figure 10:
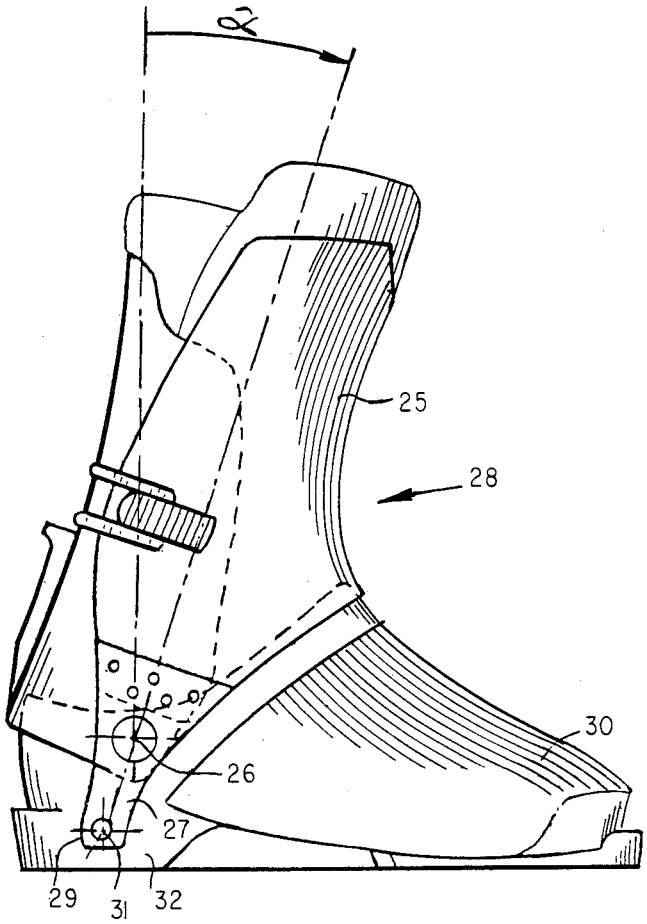
FIG. 10 illustrates an embodiment according to the invention in which the flexion blade extends radially from the journal of the upper and is directed downwardly in general alignment with the inclination axis of the upper. In this embodiment, and by way of example only, the extension acting as the flexion blade is made out of a different material than the remainder of the cuff and is attached thereto by means which are known in themselves.

According to an alternative embodiment illustrated in FIG. 10, extension 27 constituting the flexion blade, extending from cuff 25, is positioned to extend radially and downwardly from journal axis 26 of the cuff along a direction which is substantially aligned with the orientation axis of upper 28 subjected to advancement angle $\alpha$. In this embodiment, end 29 of extension 27 is made integral with shell base 30 adjacent to heel 32 of the boot by means of an assembly system 31 such as was explained above. Various modifications are possible, and, for example, it is possible to provide means for adjusting the effective length of the blade in the heel zone such as by an arrangement similar to any of those described above so as to be able to select, for example, a desired static advancement angle.

In the embodiments described above, the shape of extension 7 constituting the flexion spring is that of a simple blade having a generally rectangular shape. It is clear that depending upon the case, the shape of this element can vary as a function of the necessities of construction, for aesthetic reasons, and/or for distribution of stresses in the active portion. The extension 7 can be in the form of several distinct arms which may or may not be parallel over at least a portion of the active zone situated between journal 3 and the support point and/or attachment point 8 of extension 7 on shell base 1.

Thus, for example, in a preferred embodiment shown in FIGS. 12 and 13, the journal axle of the cuff and the support point of flexion blade 37 are established by one and the same part which reduces the costs of material used and the costs of assembly for forming such a boot. This single part is composed of a sort of clip or staple 39 in which one of the cylindrical arms 33 serves as the journal for the cuff 35 while the other serves as a support point 38 for the flexion blade. Thus, as was explained above, the central portion 39' connecting the two arms 33 and 38 serves, along the variations of its cross section, as a supplemental metallic spring positioned in parallel with the flexion blade. By using different interchangeable clips, different flexibilities can be achieved. It is clear that this embodiment is likewise applicable to various structures of boots such as were described above.

Since the construction materials normally utilized are relatively rigid plastics such as polyamides and polyacetals, extension 7 will more preferably be made of unitary construction with cuff 5 during its molding. However, instead of molding, this extension can alternatively be applied during the assembly of cuff 5 and in this case it may assume the form of a metallic part preferably positioned under cuff 5 so as to protect it against possible kicks (FIG. 10).

Although the invention has been described with reference to particular means, materials and embodiments it is to be understood that the invention is not limited to the particulars disclosed and extends to all equivalents falling within the scope of the claims.

What is claimed is:

1. A ski boot for use in Alpine skiing, said boot comprising a shell base and an upper, said upper being adapted to pivot around a horizontal transverse journal axis, said upper comprising a cuff and a rear spoiler, said upper further comprising at least one extension extending from said journal axis, said at least one extension being adapted to cooperate at its end spaced from said upper with a support point on said shell base, wherein said at least one extension comprises a flexion blade extending between said journal axis and said support point which resists pivoting of said upper relative to said shell base, wherein said end of said extension is fixedly attached to said shell base at said support point.

2. The ski boot as defined by claim 1 wherein said at least one extension further serves to establish the static advancement angle of said upper relative to said shell base, and is specifically adapted to resist forward pivoting of said upper.

3. The ski boot as defined in claim 1 wherein said support point is integral with said shell base.

4. The ski boot as defined by claim 1 wherein said at least one extension extends from said cuff at the level of said journal axis in a generally longitudinal direction relative to the axis of the boot.

5. The ski boot as defined by claim 4 wherein said flexion blade is directed toward the front of the boot.

6. The ski boot as defined by claim 4 wherein said flexion blade is directed toward the rear of the boot.

7. The ski boot as defined by claim 6 wherein said spoiler is integral with said shell base.

8. The ski boot as defined by claim 1 wherein said at least one extension extends downwardly from said cuff and is aligned with the axis of said upper, said support point being in the general vicinity of the heel of said boot.

9. The ski boot as defined by claim 1 wherein said boot is adapted for rear insertion of the foot.

10. The ski boot as defined by claim 1 wherein said boot is adapted for front insertion of the foot.

11. The ski boot as defined by claim 1 wherein said extension comprises a flexion blade which is prestressed during assembly.

12. The ski boot as defined by claim 1 wherein said support point comprises assembly means affixed to the ski boot.

13. The ski boot as defined by claim 1 wherein said journal axis and said support point are established by means of a single staple.

14. The ski boot as defined by claim 13 wherein said staple has each of its ends inserted at said journal axis and said support point and extends through said shell base and said extension at each of said journal axis and said support point.

15. The ski boot as defined by claim 1 further comprising means for adjusting the static advancement angle of said upper relative to said shell base.

16. The ski boot as defined by claim 15 wherein said means for adjusting said static advancement angle comprises means for locking the end of said extension at a predetermined position along a slot in said shell base.

17. The ski boot as defined by claim 16 further comprising a shank for guiding the movement of said extension along said slot, and wherein said slot is arctuate.

18. The ski boot as defined by claim 17 wherein said slot is generally vertical.

19. The ski boot as defined by claim 16 wherein said slot is generally horizontal.

20. The ski boot as defined by claim 16 wherein said slot is generally diagonal.

21. The ski boot as defined by claim 1 further comprising means for adjusting the effective length of said extension between said journal axis and said support point.

22. The ski boot as defined by claim 21 wherein said means for adjusting the effective length of said extension comprises a movable cursor adapted to slide along said extension to establish the support point of said extension on said shell base.

23. The ski boot as defined by claim 22 wherein said cursor is mounted on said shell base.

24. The ski boot as defined by claim 23 wherein said cursor is slidably seated within a groove in said shell base, said cursor being adapted to cooperate and be held in position by the edges of said groove.

25. The ski boot as defined by claim 23 wherein said boot comprises a rail mounted on said shell base, and wherein said cursor is guided in its movement by said rail, said cursor being adapted to hold said extension.

26. The ski boot as defined by claim 1 further comprising means for adjusting the position of said support point in a manner so as to affect the static advancement angle and the rigidity of said extension according to a predetermined inter-relationship.

27. The ski boot as defined by claim 26 wherein said means for adjusting the position of said support point comprises two slots provided in said shell base and said extension, and wherein said means for adjusting the position of said adjustment point further comprises means for attaching said shell base and said extension.

28. The ski boot as defined by claim 27 wherein each of said slots is identical.

29. The ski boot as defined by claim 28 further comprising means for adjusting the static advancement angle of said upper comprising a cylindrical shank extending through said slot in said shell base, said shank ending in a head adapted to press against the internal surface of said shell base, said shank being secured to said extension by means of a threaded shank upon which is screwed a nut adapted to press said extension against said shell base whereby the position of said extension relative to said shell base can be varied by loosening and retightening said nut.

30. The ski boot as defined by claim 29 wherein the internal surface of said shell base comprises a groove extending along said slot on the interior surface of said shell base, said groove being adapted to seat said head.

31. The ski boot as defined by claim 30 wherein said head comprises spurs adapted to cooperate with cavities provided in said shell base at regular intervals along said slot so as to define predetermined positons along said slot for said head.

32. The ski boot as defined by claim 1 wherein said flexion blade comprises means for biasing said upper in a direction opposite from the direction in which said upper pivots with respect to said base, in response to pivoting of said upper with respect to said base.

33. A ski boot for use in Alpine skiing, said boot comprising a shell base and an upper, said upper being adapted to pivot around a horizontal transverse journal axis, said upper comprising a cuff and a rear spoiler, said upper further comprising at least one extension extending from said journal axis, said at least one extension being adapted to cooperate at its end spaced from said upper with a support point on said shell base, wherein said at least one extension comprises a flexion blade extending between said journal axis and said support point, said extension serving to define the static advancement angle of said upper relative to said shell base, wherein said end of said extension is fixedly attached at said support point on said shell base.

34. The ski boot as defined by claim 33 wherein said flexion blade comprises means for biasing said upper in a direction opposite from the direction in which said upper pivots with respect to said base, in response to pivoting of said upper with respect to said base.

35. A ski boot for use in Alpine skiing, said boot comprising a shell base an an upper, said upper being adapted to pivot around a horizontal transverse journal axis, said upper further comprising at least one extension extending from said journal axis, said at least one extension being adapted to cooperate at its end spaced from said upper with a support point on said shell base and wherein said at least one extension comprises a flexion blade extending between said journal axis and said support point which resists pivoting of said upper relative to said shell base, and defines the static advancement angle of said upper relative to said shell base, wherein said end of said extension is fixedly attached at said support point to said shell base.

36. The ski boot as defined by claim 35 wherein said flexion blade comprises means for biasing said upper in a direction opposite from the direction in which said upper pivots with respect to said base, in response to pivoting of said upper with respect to said base.

37. The ski boot defined by claim 1 wherein said boot further comprises means for fixing the angular position of said extension at said journal axis and means for adjusting and fixing the location of said support point.

38. The boot as defined by claim 37 wherein said means for fixing the angular position of said extension comprises a shank extending through said extension and inot said upper.

39. A ski boot for use in Alpine skiing, said boot comprising a shell base and an upper, said upper comprising a cuff and a rear spoiler integral with said shell base, said cuff and rear spoiler comprising closure means for securing said cuff and rear spoiler together around the foot of the user, said cuff being secured to said shell base and being pivotable relative to said shell base along a transverse horizontal axis during use, said cuff further comprising at least one extension extending from said journal axis adapted to cooperate at its end spaced from said cuff with a support point on said shell base, wherein said at least one extension comprises a flexion blade extending between said journal axis and support point which resists pivoting of said upper relative to said shell base, and wherein said end of said extension is fixedly attached at said support point to said shell base.

40. The ski boot as defined by claim 39 wherein said flexion blade comprises means for biasing said upper in a direction opposite from the direction in which said upper pivots with respect to said base, in response to pivoting of said upper with respect to said base.

* * * * *